US007591664B2

(12) United States Patent
Nomiyama et al.

(10) Patent No.: US 7,591,664 B2
(45) Date of Patent: Sep. 22, 2009

(54) LOC-EQUIPPED CONNECTOR

(75) Inventors: Toru Nomiyama, Tokyo (JP); Osamu Hashiguchi, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/253,283

(22) Filed: Oct. 17, 2008

(65) Prior Publication Data

US 2009/0130876 A1 May 21, 2009

(30) Foreign Application Priority Data

Nov. 16, 2007 (JP) ..... 2007-298488

(51) Int. Cl.
*H01R 13/627* (2006.01)

(52) U.S. Cl. ..... 439/352

(58) Field of Classification Search ..... 439/352, 439/353, 357, 358
See application file for complete search history.

(56) References Cited

U.S. PATENT DOCUMENTS 6,312,277 B1 * 11/2001 Holub ..... 439/352
6,346,002 B1 * 2/2002 Hsu et al. ..... 439/358
2007/0173099 A1 * 7/2007 Jenkinson et al. ..... 439/352

FOREIGN PATENT DOCUMENTS

JP 8-273764 A 10/1996

* cited by examiner

*Primary Examiner*—Phuong K Dinh
(74) *Attorney, Agent, or Firm*—Frishauf, Holtz, Goodman & Chick, P.C.

(57) ABSTRACT

A lock-equipped connector capable of preventing plastic deformation of a spring section of a locking member even when the connector is made compact in size. The locking member has a pair of arms extending in a fitting/removing direction of the connector, a connecting portion that connects the arms, a spring section, and engaging nails formed on the arms. The spring section has a first spring portion extending from the connecting portion in the fitting/removing direction, a second and a third spring portions extending from an end of the first spring portion opposite from the connecting portion side in a manner folded back toward one side and the other side of the connecting portion, respectively. A first and second fixing portions are connected to the second and third spring portions, respectively, and are fixed to the housing.

5 Claims, 6 Drawing Sheets

LOC-EQUIPPED CONNECTOR

BACKGROUND OF THE INVENTION

1. Field of the Invention

This invention relates to a connector, and more particularly to a lock-equipped connector.

2. Description of the Related Art

Conventionally, there has been proposed a connector provided with an insulator (housing) and a front shell (see Japanese Patent Laid-Open Publication No. H08-273764 (paragraphs [0012] to [0017] and FIG. 1)).

The insulator is comprised of a body and an insertion portion. The body holds a plurality of contacts.

The insertion portion is generally plate-shaped, and is inserted into a receiving portion of a mating connector. Grooves are formed at respective laterally opposite ends of the insertion portion.

The front shell also serves as a locking member for locking the mating connector. The front shell is comprised of a front shell body, a pair of hooks, a connecting portion, and a movable piece. The front shell body covers the insulator. The pair of hooks each have a foremost end formed with an approximately triangular engaging nail that is hooked to the mating connector. The pair of hooks are arranged in the associated grooves of the insertion portion of the insulator except for the engaging nails. The engaging nails protrude from the associated grooves. The connecting portion joins the pair of hooks to each other. A protrusion is formed on a central part of the connecting portion. The movable piece has a spring section in the form of a plate. The movable piece has the connecting portion integrally formed therewith at one end thereof, and has the front shell body connected to the other end thereof. The movable piece is capable of bending in the direction of a plate thickness thereof. By bending the movable piece, it is possible to move the pair of hooks in the respective groves in the direction of thickness of the insertion portion.

The front shell is combined with a back shell to cover the whole insulator. The front shell and the back shell are covered with a hood. The hood includes a pressing portion. When the pressing portion is pressed, the protrusion of the connecting portion is pressed, whereby the respective engaging nails of the pair of hooks are withdrawn into the associated grooves (toward the bottom surfaces of the associated grooves).

When the insertion portion of the insulator of the connector is inserted into the receiving portion of the mating connector, the respective engaging nails of the pair of hooks are pushed into the associated grooves by the mating shell that covers the receiving portion.

When the insertion portion of the insulator is inserted into the receiving portion of the mating connector until the engaging nails of the hooks reach locking holes formed in the mating shell, the engaging nails are inserted into the locking holes of the mating shell by the spring force of the movable piece of the front shell. As a result, the connector is locked by the mating connector.

On the other hand, when the connector is to be removed from the mating connector, it is only required to press the pressing portion of the hood of the connector and pull the connector in the removing direction with the pressing portion pressed. When the pressing portion is pressed, the connecting portion is pressed via the protrusion to cause the engaging nails of the hooks to be moved away from the locking holes of the mating shell, and be withdrawn into the grooves. As a consequence, the mating connector is unlocked from the connector, thereby making it possible to remove the connector from the mating connector.

Recently, there is an increasing demand for making connectors compact in size. When a connector is made compact in size, the spring length of a spring section (movable piece of a front shell) of the connector is accordingly reduced.

However, to reliably maintain the connector in a state locked to a mating connector, engaging nails of hooks cannot be made too small in size. This means that there is hardly any change in the amount of motion of the engaging nails of the hooks (the amount of motion of the engaging nails in the direction of thickness of an insertion portion) when the connector is fitted to the mating connector.

Therefore, although the spring length of the spring section is reduced along with the reduction of the size of the connector, there is hardly any change in the amount of motion of the engaging nails of the hooks. This causes an increase in the amount of bending of the spring section, which can cause plastic deformation of the spring section.

SUMMARY OF THE INVENTION

The present invention has been made in view of these circumstances, and an object thereof is to provide a connector which is capable of preventing plastic deformation of a spring section of a locking member even when the connector is made compact in size.

To attain the above object, the present invention provides A lock-equipped connector, comprising:

a housing including a fitting section that is generally plate-shaped, and is fitted to a mating connector, the housing holding a plurality of contacts; and a locking member including a pair of arm portions that are arranged at laterally opposite ends of the fitting section, and extend in directions of fitting and removing the connector to and from the mating connector, a connecting portion that connects the pair of arm portions to each other, a spring section that is connected to an approximately central part of the connecting portion, for urging the pair of arm portions toward the mating connector, and an engaging portion that is formed on at least one of the pair of arm portions, for being engaged with the mating connector in a direction of height of the fitting section, the spring section including a first spring portion that extends in the directions of fitting and removing the connector to and from the mating connector, a second spring portion that extends from an end of the first spring portion opposite from a connecting portion-side end of the first spring portion in a manner folded back toward one of the pair of arm portions connected by the connecting portion, a third spring portion that extends from the end of the first spring portion opposite from the connecting portion-side end of the first spring portion in a manner folded back toward the other of the pair of arm portions connected by the connecting portion, a first fixing portion that is connected to the second spring portion, and is fixed to the housing, and a second fixing portion that is connected to the third spring portion, and is fixed to the housing.

With the arrangement of the connector according to the present invention, the locking member includes not only the first spring portion but also the second and third spring portions, and hence it is possible to increase the spring length of the spring section by the second and third spring portions. Therefore, it is possible to prevent plastic deformation of the spring section of the locking member even when the connector is made compact in size.

Preferably, the lock-equipped connector includes a shell for covering the housing, and the shell is provided with an engaging portion-receiving recess for receiving the engaging portion upward.

Preferably, the lock-equipped connector includes a hood for covering the shell except for a portion of the shell, the portion covering the fitting section.

More preferably, the connecting section has a protrusion formed on the approximately central part thereof such that the protrusion extends in the direction of height of the fitting section, and the shell is formed with a protrusion receiving recess for receiving a foremost end of the protrusion upward, the hood being formed with an operating section for pushing the protrusion into the shell.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
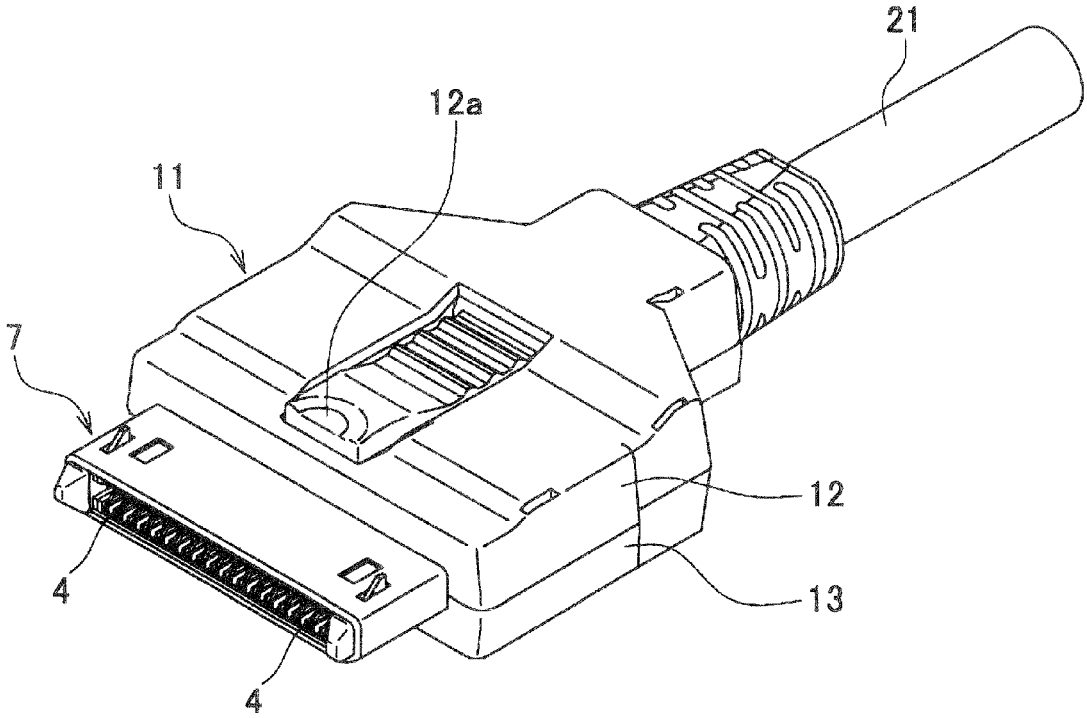
FIG. 1 is a perspective view of a lock-equipped connector, according to an embodiment of the present invention.
Figure 2:
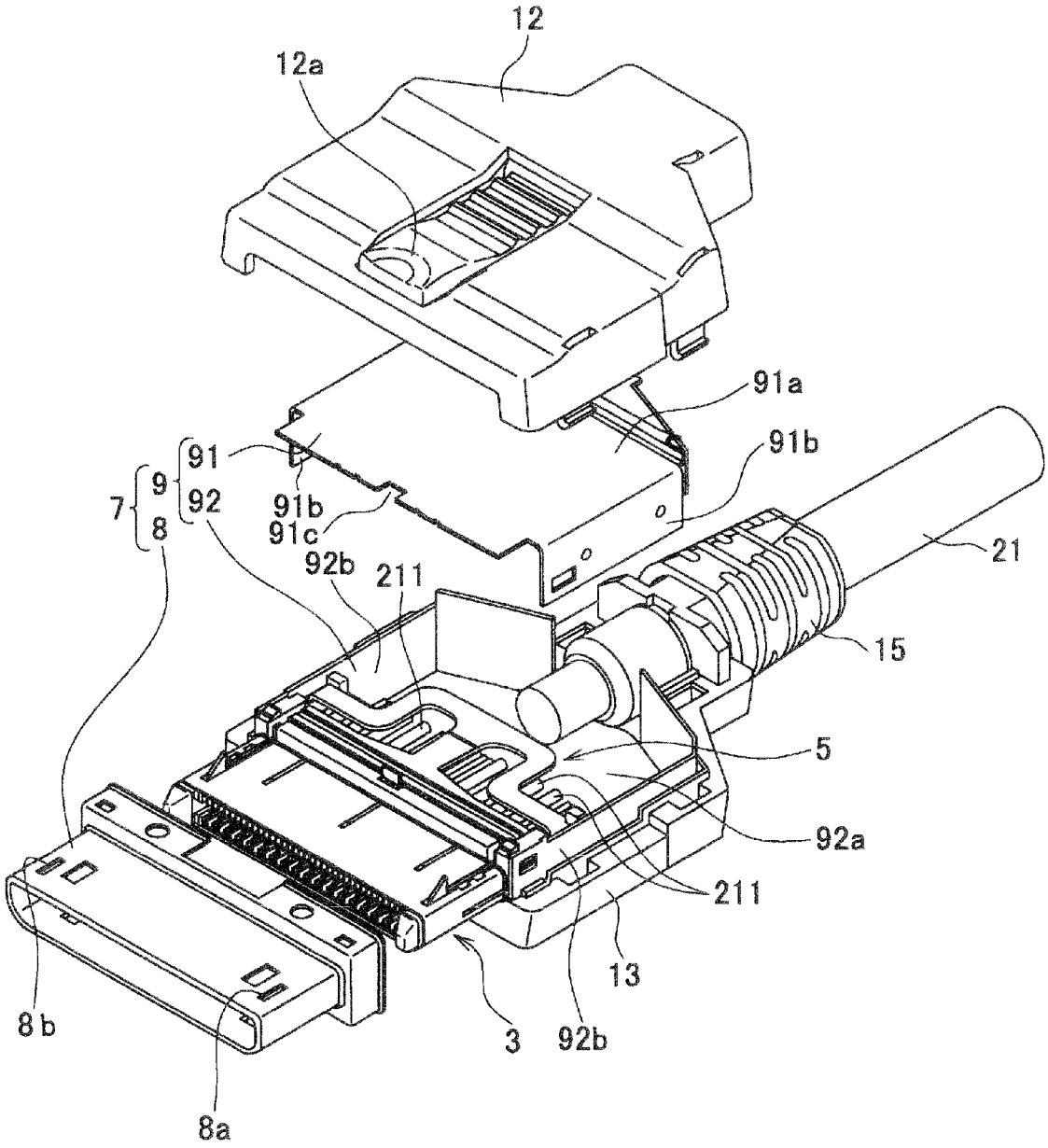
FIG. 2 is an exploded perspective view of the FIG. 1 connector.

As shown in FIGS. 1 and 2, a lock-equipped connector according to the present invention is comprised of a housing 3, a contact 4, a locking member 5, a shell 7, and a hood 11.

Figure 3:
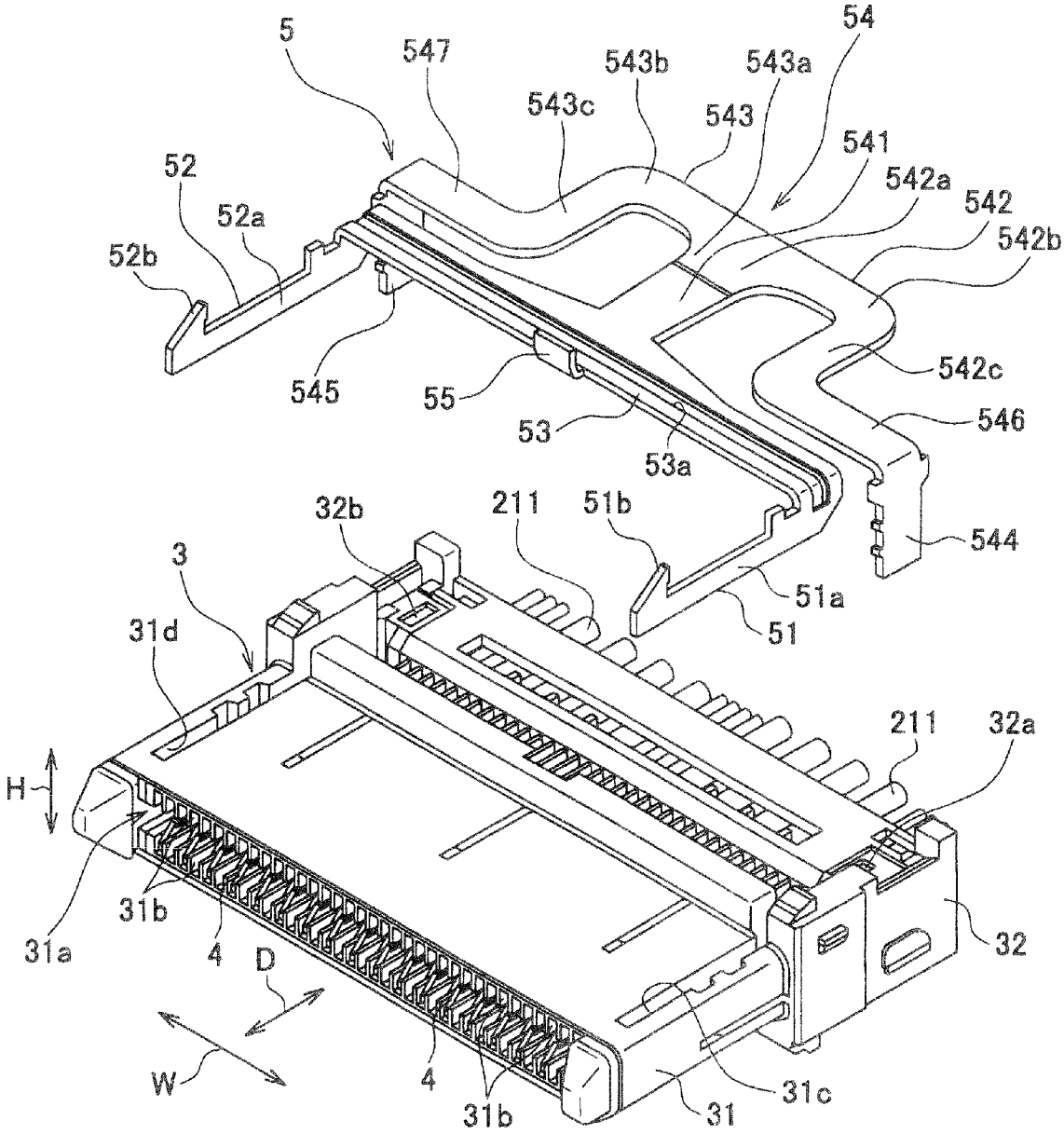
FIG. 3 is a perspective view of a housing and a locking member of the FIG. 1 lock-equipped connector.

Referring to FIG. 3, the housing 3 is comprised of a fitting section 31, and an element wire holding section 32, and is made of insulating resin.

The fitting section 31 is generally plate-shaped. The fitting section 31 has a foremost end formed with a receiving portion 31*a* (see FIG. 6) for receiving a fitting section of a mating connector, not shown. Further, the fitting section 31 is formed with a plurality of contact receiving grooves 31*b* communicating with the receiving portion 31*a*. The contact receiving grooves 31*b* are arranged at equally-spaced intervals in the lateral direction W of the fitting section 31 (see FIG. 3). Further, the contact receiving grooves 31*b* extend in the fitting/removing direction D with respect to the mating connector.

The fitting section 31 has opposite ends in the lateral direction W (opposite lateral ends) formed with grooves 31*c* and 31*d*, respectively. The grooves 31*c* and 31*d* extend in the fitting/removing direction D.

Figure 5:
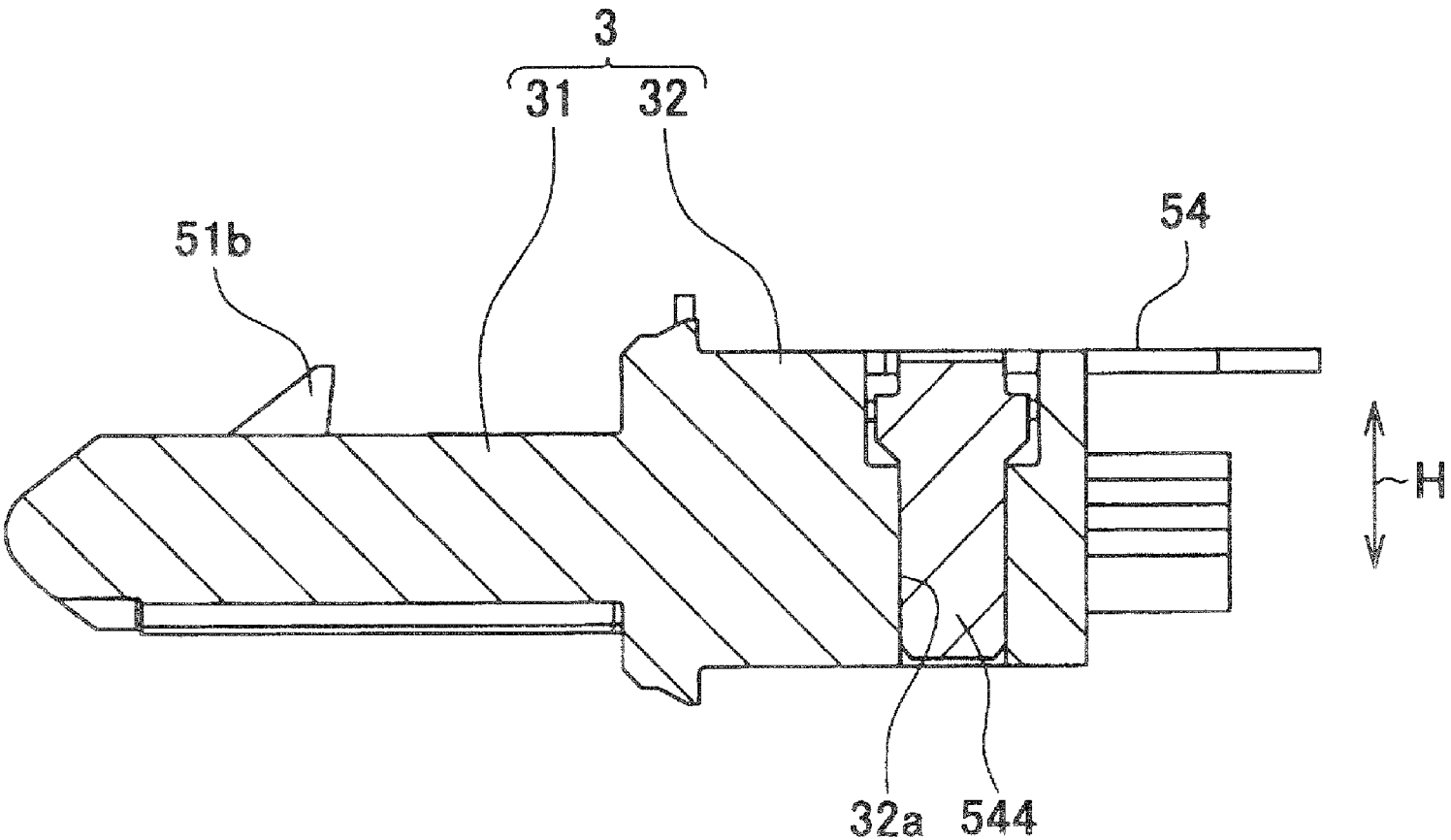
FIG. 5 is a cross-sectional view of the housing of the FIG. 1 connector.

The element wire holding section 32 holds a plurality of element wires 211 of a cable 21. Parts of the element wires 211 are omitted in FIGS. 2 and 3. The element wire holding section 32 has opposite lateral ends thereof formed with press-fitting holes 32*a* and 32*b*, respectively (see FIG. 3). The press-fitting holes 32*a* and 32*b* extend in the height direction H of the housing 3 (see FIG. 5).

The locking member 5 is comprised of a pair of hook sections 51 and 52, a connecting portion 53, a spring section 54, and a protrusion 55. The locking member 5 is formed by blanking and bending a metal plate.

The hook section 51 includes an arm (arm portion) 51*a* and an engaging nail (engaging portion) 51*b*. The arm 51*a* is in the form of a long plate. The engaging nail 51*b* is approximately in the form of a right triangle, and continues from the foremost end of the arm 51*a*.

The hook section 52 includes an arm (arm portion) 52*a* and an engaging nail (engaging portion) 52*b*. The arm 52*a* is in the form of a long plate. The engaging nail 52*b* is approximately in the form of a right triangle, and continues from the foremost end of the arm 52*a*.

The connecting portion 53 is in the form of a long plate, and connects the hook sections 51 and 52 to each other. The connecting portion 53 is formed with a slit 53*a*. The slit 53*a* extends in the length direction of the connecting portion 53. Although the connecting portion 53 is made easier to be elastically deformed by the slit 53*a*, the slit 53*a* may not be formed in the connecting portion 53. It should be noted that to enhance the rigidity of the connecting portion 53, a rib may be formed by embossing, in place of the slit 53*a*.

The spring section 54 is comprised of a first spring portion 541, a second spring portion 542, a third spring portion 543, a first fixing portion 544, a second fixing portion 545, a first connecting portion 546, and a second connecting portion 547.

The first spring portion 541 is generally plate-shaped, and extends in the fitting/removing direction D. The first spring portion 541 has one end connected to (continuous with) a central part of the connecting portion 53.

The second spring portion 542 extends from the other end (end opposite from the connecting portion-side end) of the first spring portion 541 in a manner folded back toward one side of the connecting portion 53 (toward the one arm 51*a* connected by the connecting portion 53). The second spring portion 542 includes first to third portions 542*a* to 542*c*. The first portion 542*a* continues from the other end of the first spring portion 541, and extends away from the connecting portion 53 in the fitting/removing direction D. The second portion 542*b* continues from the first portion 542*a*, and extends in the lateral direction W of the fitting section 31. The third portion 542*c* continues from the second portion 542*b*, and extends in the fitting/removing direction D such that it comes closer to the connecting portion 53.

The third spring portion 543 extends from the other end (end opposite from the connecting portion-side end) of the first spring portion 541 in a manner folded back toward the other side of the connecting portion 53 (toward the other arm 52*a* connected by the connecting portion 53). The third spring portion 543 includes first to third portions 543*a* to 543*c*. The first portion 543*a* continues from the other end of the first spring portion 541, and extends away from the connecting portion 53 in the fitting/removing direction D. Although the first portion 543*a* is integrally formed with the first portion 542*a* of the second spring portion 542, the first portion 543*a* and the first portion 542*a* may be separated in the lateral direction W of the fitting section 31. The second portion 543*b* continues from the first portion 543*a*, and extends in the lateral direction W. The third portion 543*c* continues from the second portion 543*b*, and extends in the fitting/removing direction D such that it comes closer to the connecting portion 53.

The first fixing portion 544 is generally plate-shaped, and extends in the height direction H of the housing 3 for being press-fitted into the press-fitting hole 32*a* of the housing 3.

The second fixing portion 545 is generally plate-shaped, and extends in the height direction H of the housing 3 for being press-fitted into the press-fitting hole 32*b* of the housing 3.

The first connecting portion 546 is generally plate-shaped, and extends in the lateral direction W of the fitting section 31, for joining the second spring portion 542 and the first fixing portion 544. The first fixing portion 544 is inclined approximately at right angles to the first connecting portion 546.

The second connecting portion 547 is generally plate-shaped, and extends in the lateral direction W of the fitting section 31, for joining the third spring portion 543 and the second fixing portion 545. The second fixing portion 545 is inclined approximately at right angles to the second connecting portion 547.

The protrusion 55 is formed integrally with the central part of the connecting portion 53, and protrudes in the height direction H of the housing 3.

When the first and second fixing portions 544 and 545 are press-fitted into the press-fitting holes 32*a* and 32*b* of the housing 3, respectively, the locking member 5 is fixed to the housing 3, and the pair of respective hook sections 51 and 52 are accommodated in the grooves 31*c* and 31*d* of the housing 3 except for the engaging nails 51*b* and 52*b*. The engaging nails 51*b* and 52*b* protrude from the grooves 31*c* and 31*d*, respectively. The pair of hook sections 51 and 52 arranged in the grooves 31*c* and 31*d* can be moved in the direction of the plate thickness of the spring section 54 (direction approximately parallel to the height direction H of the housing 3).

Figure 4:
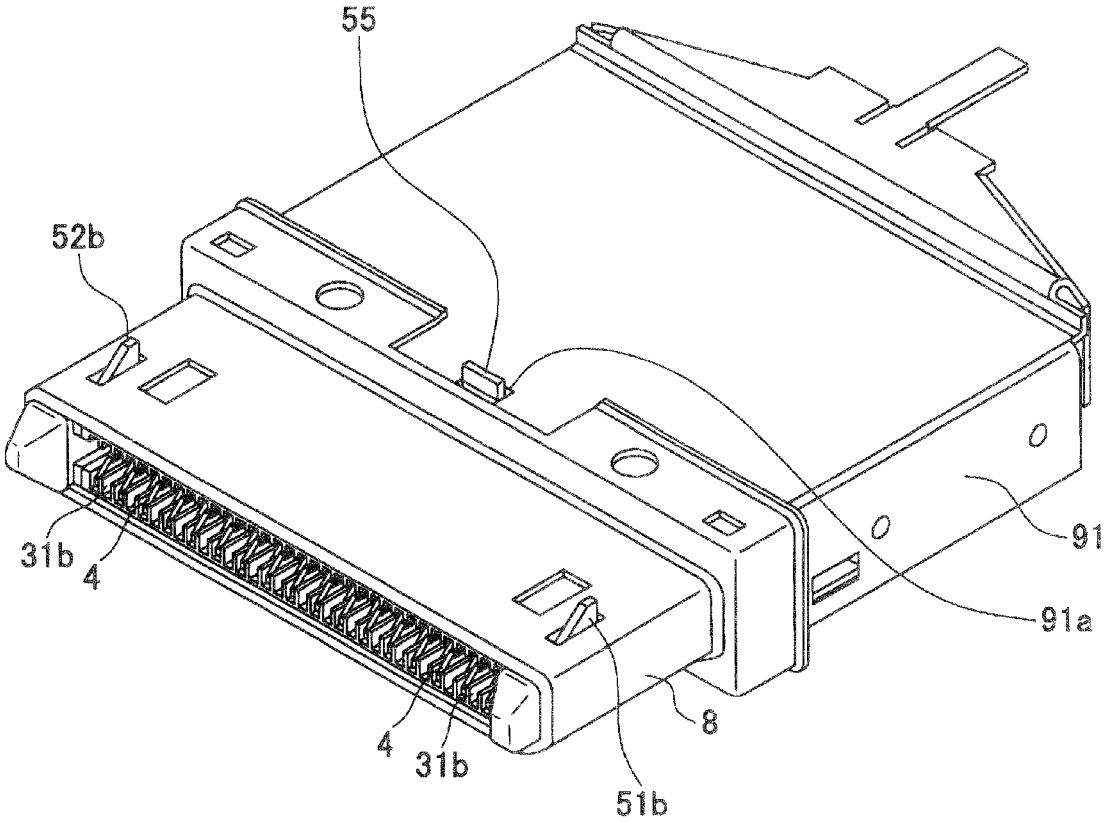
FIG. 4 is a perspective view of the FIG. 1 lock-equipped connector in a state in which a hood is removed from the connector.

As shown in FIGS. 2 and 4, the shell 7 is comprised of a front shell 8 and a rear shell 9.

The front shell 8 is made of a metal, and has a generally hollow cylindrical shape. The front shell 8 covers the fitting section 31 of the housing 3 and the front end of the rear shell 9. The front shell 8 has an upper surface formed with holes (engaging portion-receiving recesses) 8*a* and 8*b* for releasing the engaging nails 51*b* and 52*b* therein.

The rear shell 9 includes an upper shell 91 and a lower shell 92, and covers the element wire holding section 32 (see FIG. 5) and terminal parts of the element wires 211.

The upper shell 91 is substantially in the form of a casing, and includes a body 91*a* and side walls 91*b*. The upper shell 91 is formed by blanking and bending a metal plate. The body 91*a* has a front edge formed with a cutout (protrusion-passing recess) 91*c* for passing the protrusion 55 of the locking member 5.

The lower shell 92 is substantially in the form of a casing, and includes a body 92*a* and side walls 92*b*. The lower shell 92 is formed by blanking and bending a metal plate. The element wire holding portion 32 (see FIG. 5) of the housing 3 is fixed in the lower shell 92. Further, the side walls 91*b* of the upper shell 91 are inserted between the side walls 92*b* of the lower shell 92 and the element wire holding section 32, and are fixed to the element wire holding section 32.

Figure 6:
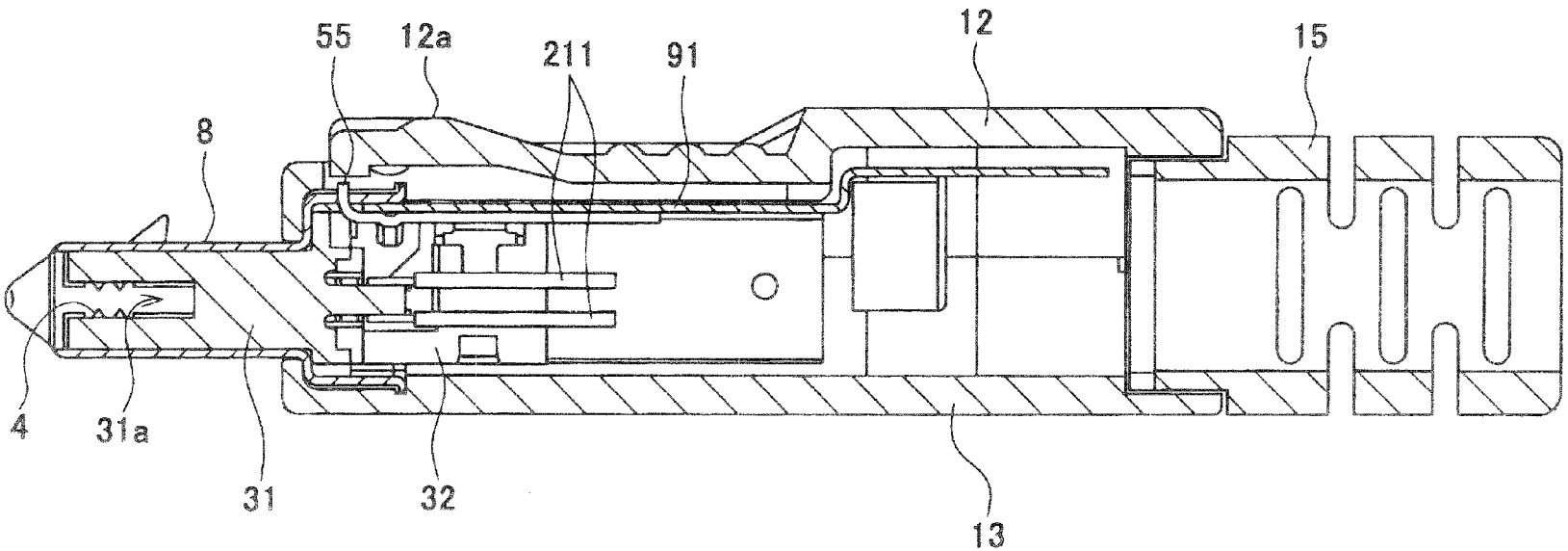
FIG. 6 is a cross-sectional view of the FIG. 1 connector.

As shown in FIGS. 1, 2, and 6, the hood 11 is comprised of an upper hood 12 and a lower hood 13.

The upper hood 12 has a shape similar to that of the upper shell 91, and covers the upper shell 91. The upper hood 12 is formed with a button (operating section) 12*a*. The button 12*a* can be moved in the height direction H.

The lower hood 13 has a shape similar to that of the lower shell 92, and covers the lower shell 92. The upper hood 12 is engaged with the lower hood 13. Further, the lower hood 13 cooperates with the upper hood 12 to hold a boot 15 through which the cable 21 is passed.

To connect the connector and the mating connector, the connectors are fitted to each other.

When a fitting section of the mating connector is inserted into the receiving portion 31*a* of the fitting section 31 of the connector, a mating shell covering the fitting section of the mating connector presses the engaging nails 51*b* and 52*b* of the pair of hook sections 51 and 52, whereby the engaging nails 51*b* and 52*b* are pushed into the grooves 31*c* and 31*d* of the fitting section 31, respectively.

When the engaging nails 51*b* and 52*b* are pushed into the grooves 31*c* and 31*d* of the fitting section 31 by the mating shell, respectively, the spring section 54 of the locking member 51 is elastically deformed in the direction of the plate thickness thereof. At this time, since the total spring length of the spring section 54 is extended by the second and third spring portions 542 and 543, the twisting and bending of the spring section 54 in the direction of the plate thickness thereof are suppressed, which makes it difficult for the spring section 54 to undergo plastic deformation.

When the fitting section of the mating connector is inserted to a predetermined position of the receiving portion 31*a* of the fitting section 31 of the connector whereby locking holes formed in the mating shell reach the engaging nails 51*b* and 52*b*, the engaging nails 51*b* and 52*b* are inserted into the locking holes of the mating shell by the spring force of the spring section 54 of the connector. As a result, the mating connector is locked to the connector.

To remove the mating connector from the connector, the button 12*a* of the hood 11 of the connector is depressed. When the button 12*a* is depressed, the connecting portion 53 is pressed by the protrusion 55, whereby the engaging nails 51*b* and 52*b* of the hook sections 51 and 52 are moved away from the locking holes of the mating shell, and are withdrawn into the grooves 31*c* and 31*d*. As a consequence, the mating connector is unlocked from the connector.

If the mating connector, in an unlocked state, is pulled in the direction of removing the same, the mating connector is removed from the connector.

According to the present embodiment, the spring length of the spring section 54 is increased by the second and third spring portions 542 and 543, so that if the connector is made compact in size, it is possible to prevent plastic deformation of the spring section 54.

Further, since the connector is provided with the shell 7, it is excellent in shielding performance.

Furthermore, since the locking member 5 includes the protrusion 55, it is possible to easily release the locking of the mating connector by operating the button 12*a* of the hood 11.

It should be noted that although in the above-described embodiment, the second and third spring portions 542 and 543 continue to the first and second fixing portions 544 and 545 via the first and second connecting portions 546 and 547, the second and third spring portions 542 and 543 may directly continue to the first and second fixing portions 544 and 545.

Further, the first and second connecting portions 546 and 547 may be configured such that they are elastically deformed as fourth portions of the second and third spring portions 542 and 543.

It should be noted that although the second portions 542*b* and 543*b* of the second and third spring portions 542 and 543 linearly extend in the lateral direction W of the fitting section 31, there is no need to linearly form the portions 542*b* and 543*b*, but they may be formed into arcuate shapes.

Further, although in the embodiment shown in FIGS. 1 to 6, the engaging nails 51*b* and 52*b* are provided in both of the arms 51*a* and 52*a* of the locking member 5, respectively, this is not limitative, but only one of the arms 51*a* and 52*a* may be provided with an engaging nail. In this case as well, it is possible to obtain the same advantageous effects as provided by the above-described embodiment.

It is further understood by those skilled in the art that the foregoing are the preferred embodiments of the present invention, and that various changes and modification may be made thereto without departing from the spirit and scope thereof.

What is claimed is:

1. A lock-equipped connector, comprising:

a housing including a fitting section that is generally plate-shaped, and is fitted to a mating connector, said housing holding a plurality of contacts; and a locking member including a pair of arm portions that are arranged at laterally opposite ends of said fitting section, and extend in directions of fitting and removing the connector to and from the mating connector, a connecting portion that connects said pair of arm portions to each other, a spring section that is connected to an approximately central part of said connecting portion, for urging said pair of arm portions toward the mating connector, and an engaging portion that is formed on at least one of said pair of arm portions, for being engaged with the mating connector in a direction of height of said fitting section, said spring section including a first spring portion that extends in the directions of fitting and removing the connector to and from the mating connector, a second spring portion that extends from an end of said first spring portion opposite from a connecting portion-side end of said first spring portion in a manner folded back toward one of said pair of arm portions connected by said connecting portion, a third spring portion that extends from the end of said first spring portion opposite from the connecting portion-side end of said first spring portion in a manner folded back toward the other of said pair of arm portions connected by said connecting portion, a first fixing portion that is connected to said second spring portion, and is fixed to said housing, and a second fixing portion that is connected to said third spring portion, and is fixed to said housing.

2. A lock-equipped connector as claimed in claim 1, including a shell for covering said housing, wherein said shell is provided with an engaging portion-receiving recess for receiving said engaging portion upward.

3. A lock-equipped connector as claimed in claim 1, including a hood for covering said shell except for a portion of said shell, said portion covering said fitting section.

4. A lock-equipped connector as claimed in claim 2, including a hood for covering said shell except for a portion of said shell, said portion covering said fitting section.

5. A lock-equipped connector as claimed in claim 2, wherein said connecting section has a protrusion formed on the approximately central part thereof such that said protrusion extends in the direction of height of said fitting section, wherein said shell is formed with a protrusion receiving recess for receiving a foremost end of said protrusion upward, and wherein said hood is formed with an operating section for pushing said protrusion into said shell.

* * * * *